United States Patent [19]

Nesse

[11] Patent Number: 4,864,656

[45] Date of Patent: Sep. 12, 1989

[54] REMOVABLE INSERT ASSEMBLY FOR JACKETS

[76] Inventor: Gary E. Nesse, P.O. Box 3871, Missoula, Mich. 59801

[21] Appl. No.: 230,778

[22] Filed: Aug. 10, 1988

[51] Int. Cl.[4] ..... A41D 1/02; A41D 27/04

[52] U.S. Cl. ..... 2/97; 2/243 R; 2/108

[58] Field of Search ..... 2/69, 69.5, 70, 76, 2/84, 102, 108, 94, 95, 97, 86, 87, 243 R, DIG. 3

[56] References Cited

U.S. PATENT DOCUMENTS

| | | | |
|---|---|---|---|
| Re. 9,631 | 3/1881 | Malmar | 2/97 |
| 214,431 | 4/1879 | Malmar | 2/97 |
| 1,164,423 | 6/1916 | Whittaker | 2/97 |
| 1,195,738 | 8/1916 | Rose | 2/97 |
| 2,642,571 | 6/1953 | Brown | 2/97 |
| 3,076,206 | 2/1963 | Shaw et al. | 9/330 |
| 3,105,981 | 10/1963 | Bennett | 9/316 |
| 3,199,128 | 8/1965 | Nöjd | 9/316 |
| 4,017,926 | 4/1977 | Piel | 9/331 |
| 4,089,065 | 5/1978 | McGee | 2/2 |
| 4,242,769 | 1/1981 | Rayfield et al. | 2/79 X |
| 4,390,996 | 7/1983 | Read | 2/86 X |
| 4,533,335 | 8/1985 | Hoshino | 2/2.1 R X |
| 4,604,759 | 8/1986 | Bowman et al. | 2/87 X |

FOREIGN PATENT DOCUMENTS

| | | | |
|---|---|---|---|
| 2459012 | 2/1981 | France . | |
| 2481224 | 10/1981 | France | 2/108 |
| 2561501 | 9/1985 | France | 2/108 |

*Primary Examiner*—Werner H. Schroeder
*Assistant Examiner*—Jeanette E. Chapman

[57] ABSTRACT

The removable insert assembly is used in combination with the jacket/vest or other types of jackets to provide thermal insulation during cold weather. The left sleeve insert and the right sleeve insert are also used in combination with the jacket/vest or other types of jackets to provide complete thermal protection to the wearer. In alternative embodiments the insert assembly and sleeve inserts can be manufactured from ballistic cloth or other suitable material to provide removable body armor to the jacket/vest or other types of jackets. In another alternative embodiment the insert assembly and sleeve inserts can be manufactured to serve as a personal flotation device when installed inside of the jacket/vest or other jackets. In another alternative embodiment a Mae West type life preserver can be used in conjunction with the jacket/vest or other types of jackets to function as a personal flotation device.

20 Claims, 4 Drawing Sheets

FIG. 4
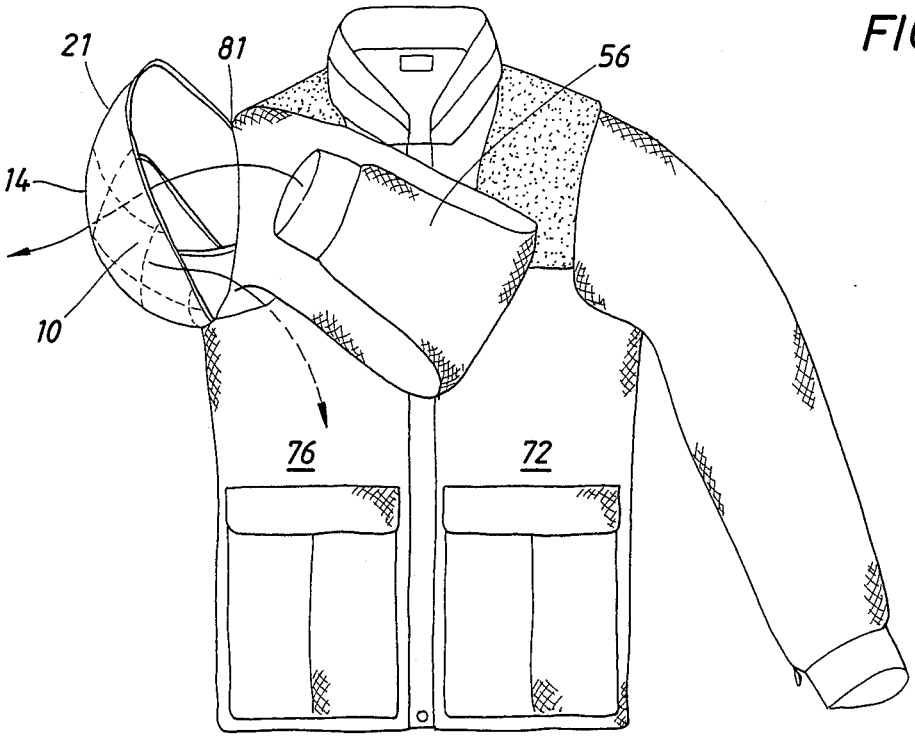
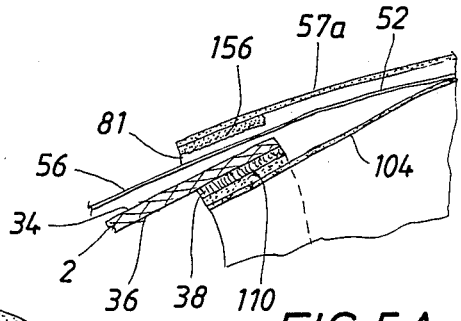
FIG. 5A
FIG. 5
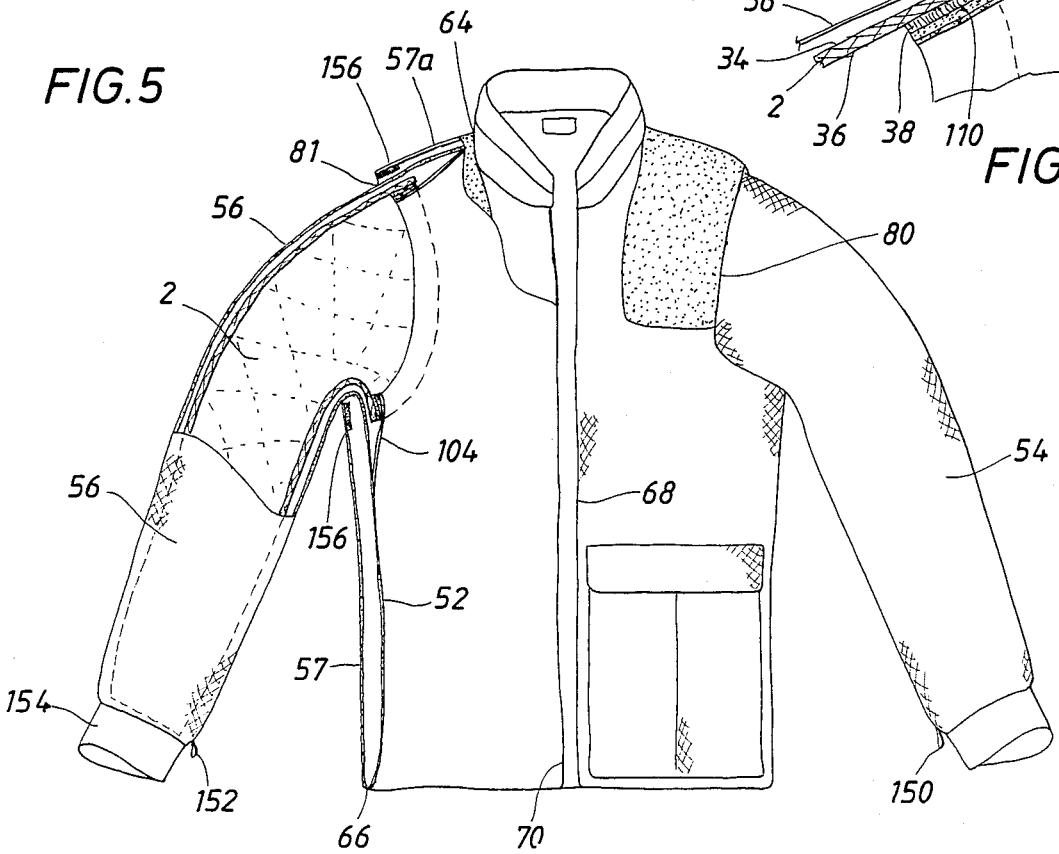

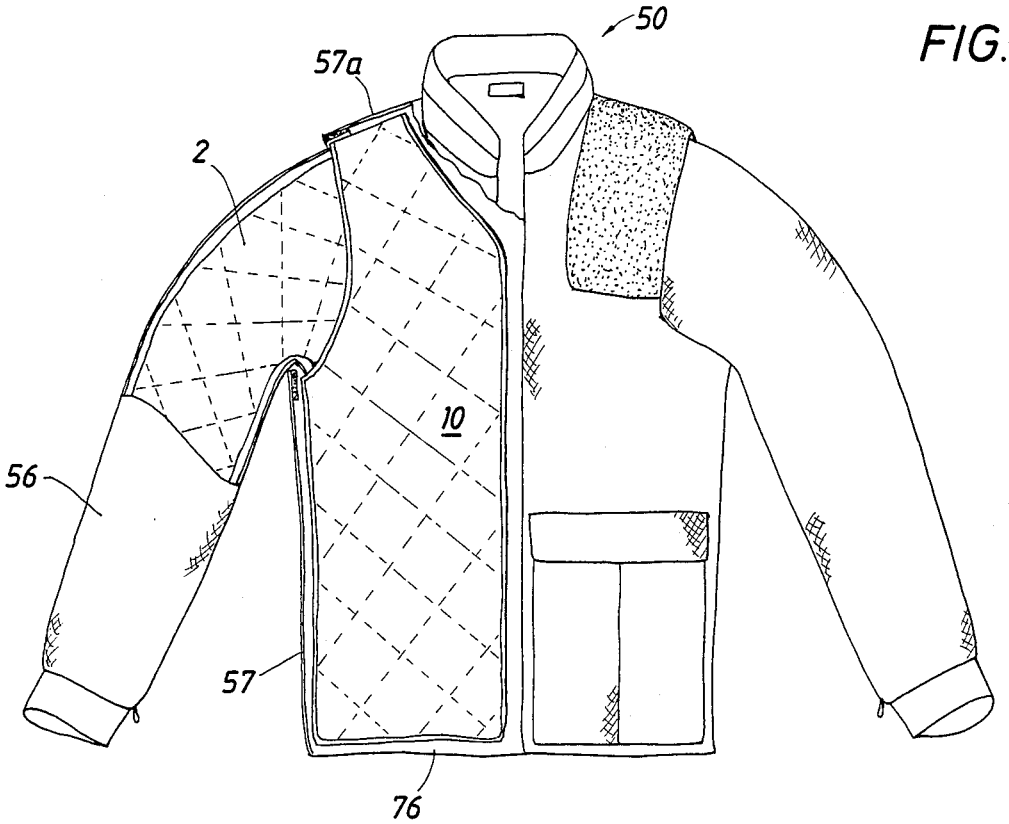
FIG. 6
FIG. 7
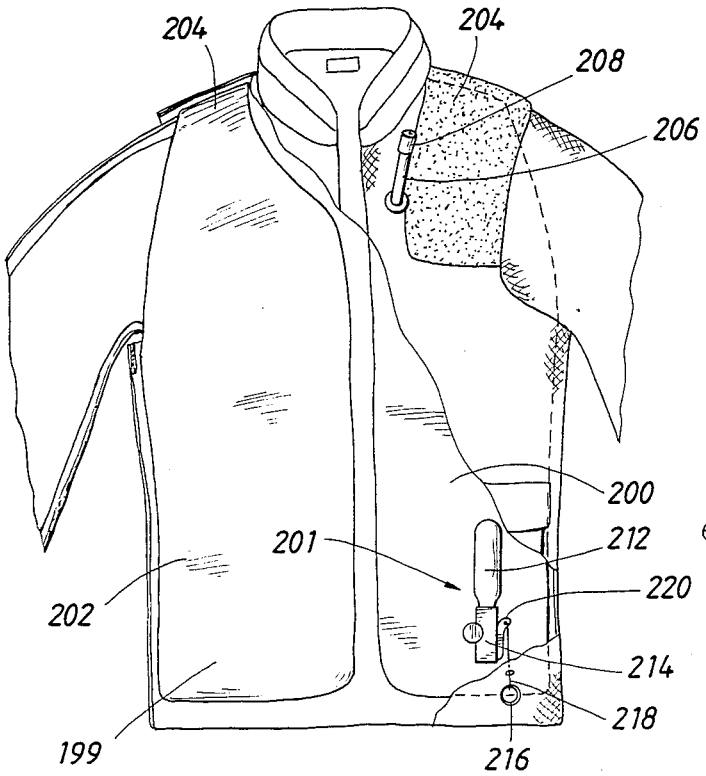
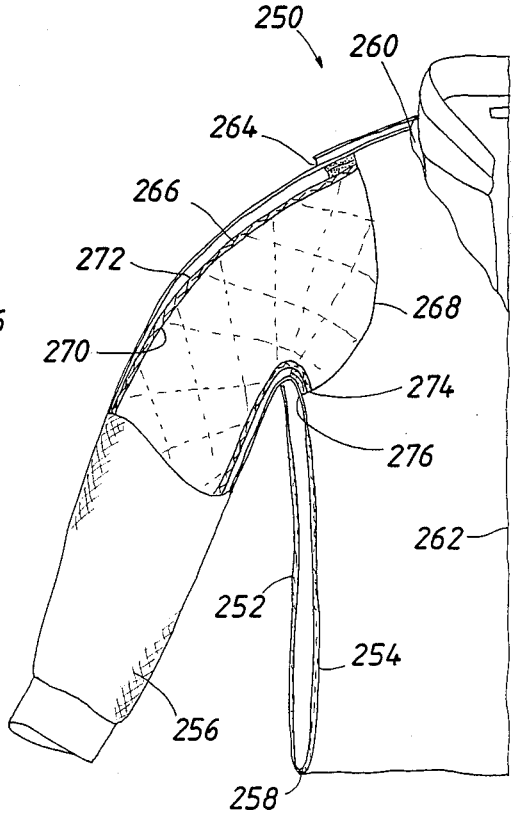
FIG. 8

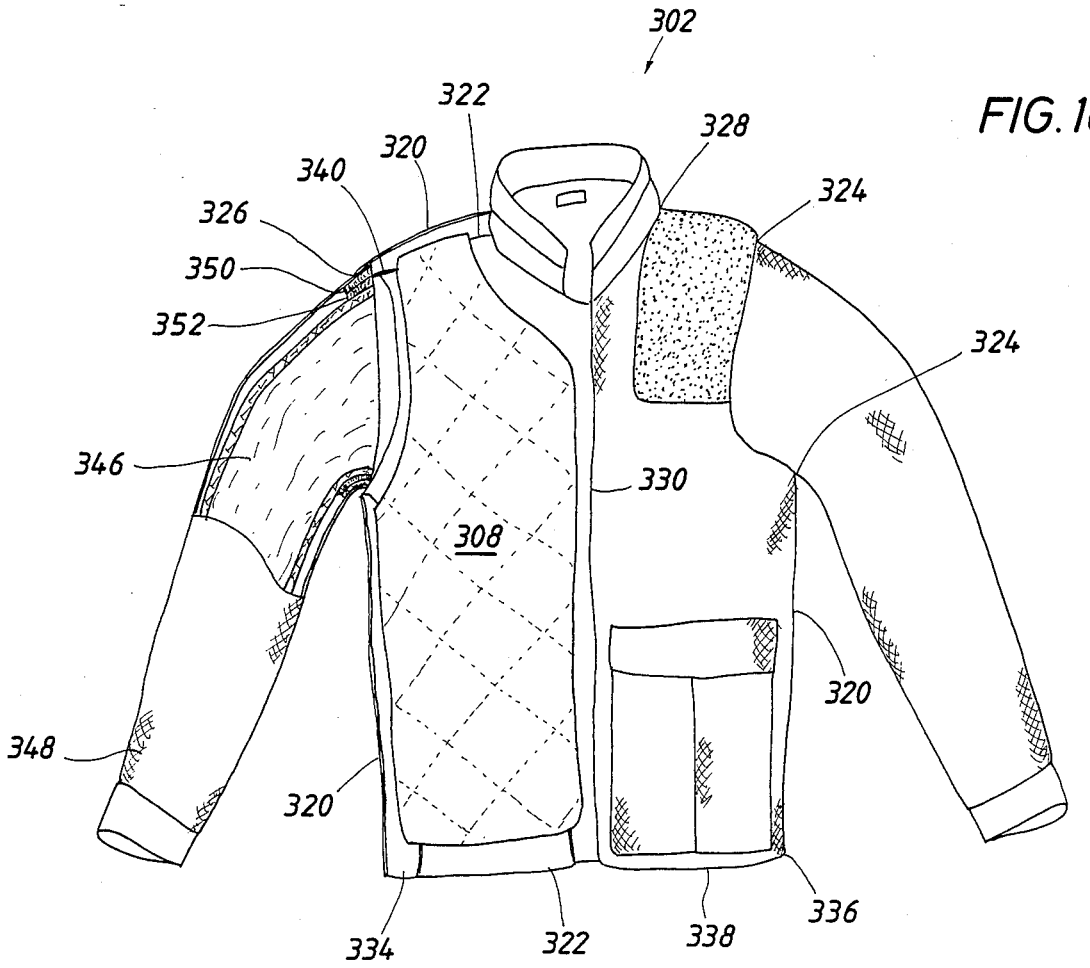
FIG. 10
FIG. 9
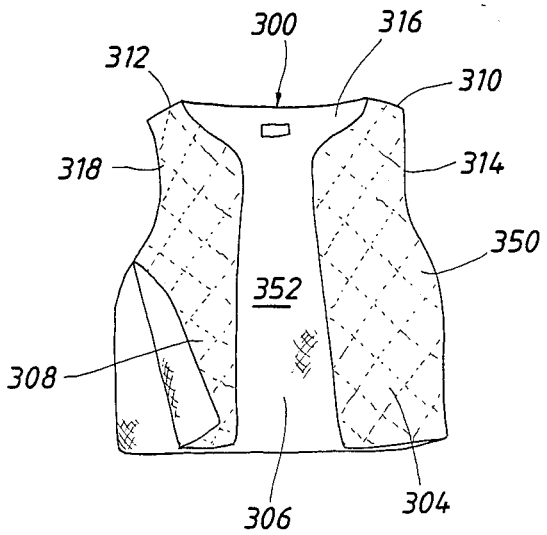

REMOVABLE INSERT ASSEMBLY FOR JACKETS

BACKGROUND OF THE INVENTION

1. Field of the Invention

This invention relates to apparel and haberdashery in Class 2.

2. Description of the Prior Art

U.S. Pat. No. 4,569,089 discloses the jacket/vest invented by Gary E. Nesse. The jacket/vest as disclosed in this prior patent could be manufactured in either an insulated or a non-insulated version. If the jacket/vest was intended for use primarily in winter weather, obviously the insulated version would be preferred. If the jacket/vest was intended for use primarily in moderate spring and fall weather, the non-insulated version would be preferred. In either event two separate and distinct jacket/vests would be required to adapt to seasonal weather fluctuations. Owning two distinct jacket/vests is expensive and takes up excessive storage space.

The present invention is a removable insert assembly which can be used in combination with the light weight jacket/vest or other types of non-insulated jackets to provide thermal insulation in winter weather or at high elevations. In addition this invention discloses a left sleeve insert and a right sleeve insert to provide total thermal insulation for the jacket/vest and other types of non-insulated jackets.

The present invention overcomes the necessity of owning both an insulated and a non-insulated jacket/vest. A single non-insulated jacket/vest when used in combination with the insert assembly and sleeve inserts can be adapted for year round use. One non-insulated jacket/vest can be owned and used in the spring and fall. The light weight jacket/vest can then be insulated for use in winter weather by installation of the removable insert assembly and the sleeve inserts. This is not only more economical, but it provides greater versatility during periods of unexpected severe weather. This versatility is also useful to those persons experiencing rapid changes in elevation with accompanying temperature extremes. The removable insert assembly and sleeve inserts are especially appreciated by outdoorsmen, offshore workers and military personnel who may be frequently moving from one elevation extreme to another or from one climatic extreme to another in a very short period of time.

In an alternative embodiment the removable insert assembly and sleeve inserts can be manufactured of ballistic cloth to provide the wearer with removable body armor.

In another alternative embodiment the removable insert assembly and sleeve inserts can be manufactured from closed cell foam or other flotation means to serve as a personal flotation device.

In another alternative embodiment an inflatable Mae West type bladder can be inserted in the jacket/vest to provide an alternative means of personal flotation. The aforementioned body armor and personal flotation devices were not disclosed in the prior patent by Gary E. Nesse.

SUMMARY OF THE INVENTION

The present invention is a removable insert assembly which fits inside of the jacket/vest or other types of non-insulated jackets. The insert assembly can be manufactured to provide thermal insulation or in alternative embodiments it can be manufactured to serve as body armor or to act as a personal flotation device. In addition the invention includes tubular sleeve inserts which can likewise be manufactured to provide thermal insulation, body armor or to act as a personal flotation device.

The removable insert assembly is sized to fit between the exterior shell and the interior lining of the jacket/vest and other types of non-insulated jackets. The tubular sleeve inserts fit inside the sleeves of the jacket/vest or other types of non-insulated jackets. The tubular sleeve inserts are removably attached to the sleeves of the jacket/vest or other types of jackets by any suitable fastening means such as Velcro brand fastening material, zippers, buttons, or snaps. The removable insert assembly is held in place between the exterior shell and the interior lining of the garment and does not require any fastening means to be correctly held in place or positioned in the garment.

BRIEF DESCRIPTION OF THE DRAWINGS

So that the manner in which the above recited features, advantages and objects of the present invention are attained and can be understood in detail, a more particular description of the invention, briefly summarized above may be had by reference to the embodiments thereof which are illustrated in the appended drawings.

It is to be noted, however, that the appended drawing illustrate only typical embodiments of this invention and are therefore not to be considered limiting of its scope, for the invention may admit to other equally effective embodiments.

FIG. 4 is a frontal perspective view of the jacket/vest and the removable insert assembly. One arrow indicates how the right sleeve passes through the right shoulder opening of the insert assembly. The other arrow indicates where the insert assembly is stuffed between the exterior shell and the interior lining of the jacket/vest.

FIG. 5 is a partial section view of the right sleeve of the jacket/vest with a right tubular sleeve insert positioned therein.

FIG. 5A is an enlargement from FIG. 5 showing a section view of a portion of the means for attaching the right tubular sleeve insert to the jacket/vest.

FIG. 6 is a frontal partial section view of the jacket/vest showing the right tubular sleeve insert in place and the removable insert assembly in place.

FIG. 7 is a partial section view of the jacket/vest with a personal flotation device inserted therein. The flotation device consists of bladder which is gas inflated and is sometimes referred to as a Mae West type life preserver.

FIG. 8 is a section view of a jacket showing an alternative means for attaching the right tubular sleeve insert.

FIG. 9 is an alternative embodiment of the assembly shown in FIG. 1.

FIG. 10 is an alternative embodiment of the jacket with the insert assembly positioned therein.

DESCRIPTION OF THE PREFERRED EMBODIMENT

Figure 1:
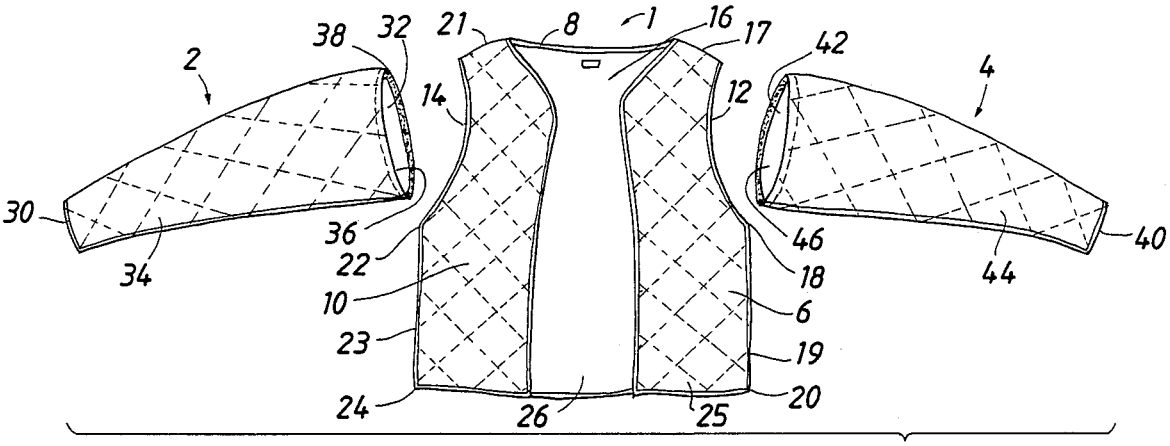
FIG. 1 is a frontal perspective view of the removable insert assembly, the left tubular sleeve insert and the right tubular sleeve insert.

In FIG. 1 the removable insert assembly, generally identified by the numeral 1, is shown in a frontal perspective view. Also shown is the right tubular sleeve insert, generally identified by the numeral 2 and the left tubular sleeve insert, generally identified by the numeral 4.

The removable insert assembly 1 consists of a left front panel 6 which is joined to a back panel 8 which is joined to a right front panel 10 There is a left shoulder opening 12 formed between the left front panel 6 and the back panel 8. There is a right shoulder opening 14 formed between the right front panel 10 and the back panel 8. There is likewise a neck opening 16 formed at the top of the insert assembly 1 between the left front panel 6, the back panel 8 and the right front panel 10. The left front panel 6 is joined to the back panel 8 at two separate seams. The first seam occurs at the upper juncture of panel 6 and panel 8 forming left strap 1, which fits over the upper area of the left shoulder. The second seam joining panels 6 and 8 occurs below the arm opening 12 between points 18 and 19. A left slit occurs between points 19 and 20; in other words panels 6 and 8 are not joined together between points 19 and 20 and are free to move independently of one another. This slit aids insertion and removal of the assembly 1 into the jacket.

Right front panel 10 is joined to the back panel 8 at two separate seams. The first seam occurs at the upper juncture of panel 10 and panel 8 forming right strap 21 which fits over the upper area of the right shoulder. The second seam joining panels 10 and 8 occurs below the right arm opening 14 between points 22 and 23. A right slit occurs between points 23 and 24; in other words panels 8 and 10 are not joined together between points 23 and 24 and are free to move independently of one another. This slit aids insertion and removal of the assembly 1 into the jacket. The left front panel 6 and the right front panel 10 are not joined together and are free to move independently of one another.

An exterior covering 25 fits over the exterior of left front panel 6, back panel 8 and right front panel 10. The left shoulder opening 12, right shoulder opening 14, neck opening 16, the left slit and the right slit are likewise formed in the exterior covering 25. An interior covering 26 is sized to fit inside of and attach to the exterior covering 25. The interior covering 26 is cut to correspond to the left shoulder opening 12, the right shoulder opening 14, the neck opening 16, the left slit and the right slit. A thermal insulator can be positioned between the exterior covering 25 and the interior covering 26. Thinsulate, down, wool or other types of thermal insulators are suitable for this purpose. Those skilled in the art will recognize that the insert assembly 1 can be manufactured in a unibody construction without the necessity of an exterior covering 25 and an interior covering 26. For example, a thick layer of wool cut from blanket-like material could be used to fabricate the insert assembly 1 without the need for exterior interior coverings.

In an alternative embodiment the removable insert assembly can be designed as a type of body armor in which ballistic cloth is placed between the exterior covering 25 and the interior covering 26. Ballistic cloth such as Kelvar is suitable for this purpose or other types of ballistic material will do.

In another alternative embodiment a flotation means can be placed between the exterior covering 25 and the interior covering 26. Closed cell elastomeric foam, kopoa or other non-hydrophobic substances may be used to manufacture a personal flotation device.

The right tubular sleeve insert 2 has a hand opening 30 at one end and a shoulder opening 32 at the other end. The right tubular insert has an exterior tubular covering 34 and an interior tubular covering 36. The exterior covering 34 and the interior covering 36 likewise have hand opening 30 and shoulder opening 42 therein. The interior covering 36 is sized to fit inside of and attach to the exterior covering 44. Positioned between the exterior tubular covering 34 and the interior tubular covering 36 is a thermal insulator. The thermal insulator can be any commercially suitable substance such as Thinsulate brand material, down, acrylic pile, wool fibers, or any other suitable insulating material. Fastening material 38 is positioned circumferentially about the shoulder opening 32 along the interior tubular covering 36 of the right tubular sleeve insert 2. The fastening material is used to hold the sleeve insert 2 in the jacket/vest, as more fully shown in FIG. 5.

Left tubular sleeve insert 4 has a hand opening 40 at one end and a shoulder opening 42 at the other end. The left sleeve insert 4 consists of an exterior covering 44 and an interior tubular covering 46. The exterior covering 44 and the interior covering 46 likewise have hand opening 40 and a shoulder opening 42 therein. The interior covering 46 is sized to fit inside of and attach to the exterior covering 44. Positioned between the exterior covering 44 and the interior covering 46 of left sleeve insert 4 is a thermal insulator. The thermal insulator can be Thinsulate brand material, down, fiber, wool, or other suitable insulating material. Those skilled in the art will recognize that left sleeve insert 4 and right sleeve insert 2 can be manufactured in a unibody construction without the necessity of an exterior covering and an interior covering. For example, a thick layer of wool, cut from blanket like material, could be used to fabricate left sleeve insert 4 and right sleeve insert 2 without the need for exterior or interior coverings.

In an alternative embodiment the sleeve inserts can be designed as a type of body armor in which ballistic cloth is placed between the exterior coverings and the interior coverings. Ballistic cloth such as Kelvar is suitable for this purpose or other types of ballistic material will do.

In another alternative embodiment a flotation means can be placed between the exterior coverings and the interior coverings. Closed cell estomeric foam, kopoa or other non-hydrophobic substances may be used to manufacture a personal flotation device.

Figure 2:
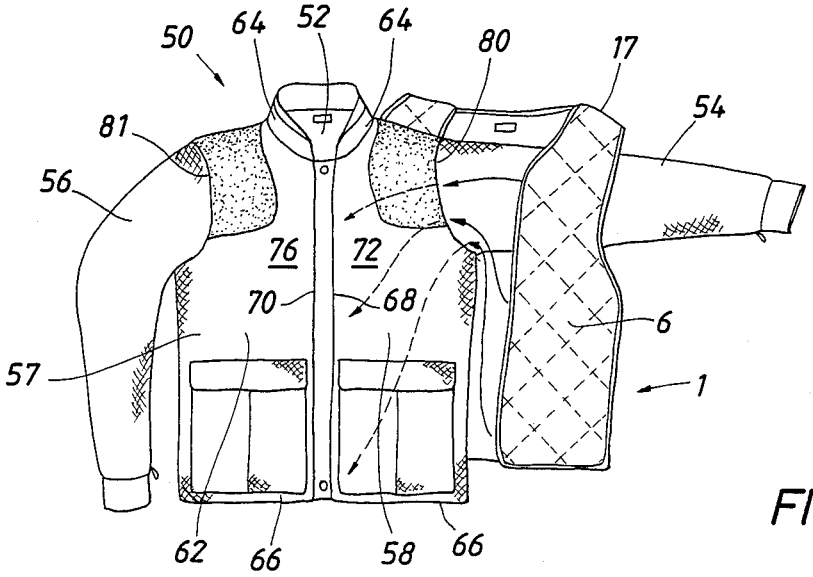
FIG. 2 is a frontal perspective view of the jacket/vest with the removable insert assembly being positioned over the left sleeve. The arrows indicate where the insert assembly is stuffed between the exterior shell and the interior lining of the jacket/vest.

FIG. 2 shows the insert assembly 1 being positioned inside of the jacket/vest 50. The jacket/vest 50 has an interior lining 52 which is attached to the left sleeve 54 and the right sleeve 56. The jacket/vest has an exterior shell 57 having a left front panel 58, a back panel 60 and a right front panel 62. The exterior shell 57 is joined to the interior lining 52 along the neck seam 64, along the torso seam 66, along the left front opening seam 68 and a right front opening seam 70. This means of attaching the exterior shell 57 to the interior lining 52 of the jacket/vest 50 creates a left front cavity 72, a back cavity 74 and a right front cavity 76 between the exterior shell and the interior lining 52. A left shoulder opening 80 is formed between the left sleeve 54 and exterior shell 57; a right shoulder opening 81 is formed between right sleeve 56 and the exterior shell 57. The left shoulder opening 80 provides easy access to left front cavity 72 and back cavity 74. The right shoulder opening 81 provides easy access to right front cavity 76 and back cavity 74. The insert assembly 1 is stuffed into the left front cavity 72, the back cavity 74 and the right front cavity 76 between the exterior shell 57 and the interior lining 52 of assembly 1 through left shoulder opening 80 and right shoulder opening 81 as more fully described hereinafter.

When properly installed, the left front panel 6 of insert assembly 1 fits inside of the left front cavity 72, the back panel 8 of insert assembly 1 fits into the back cavity 74 and the right front panel 10 of insert assembly 1 fits into right front cavity 76 between the exterior shell 57 and the interior lining 52.

In order to properly install the insert assembly in the jacket/vest 50 the left sleeve 54 is first inserted through the left shoulder opening 12 in the insert assembly 1. The left front panel 6 of the insert assembly 1 is then stuffed through the left shoulder opening 80 into the cavity 72 as shown by the arrows. The shoulder strap 17 then rests upon the interior lining 52 where it joins left sleeve 54 underneath the exterior shell.

Figure 3:
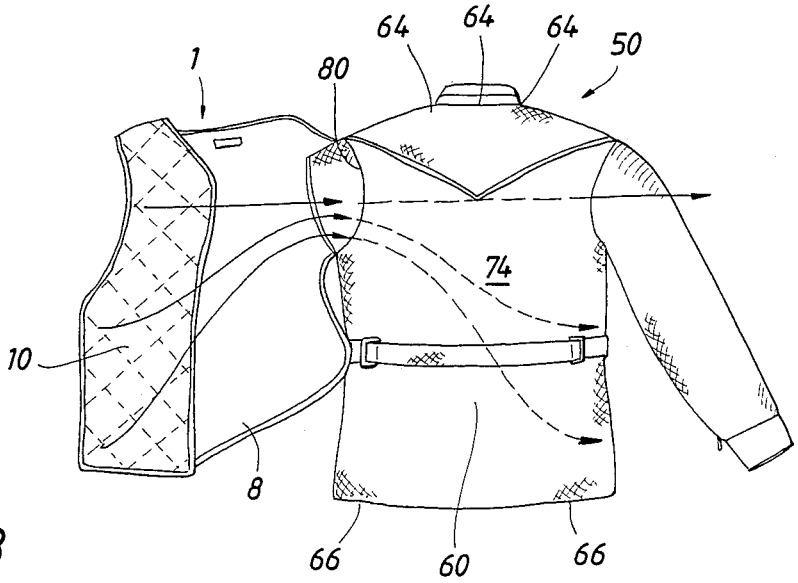
FIG. 3 is a rear perspective view of the jacket/vest and the removable insert assembly. The arrows indicate where the insert assembly is stuffed between the exterior shell and the interior lining of the jacket/vest.

In FIG. 3 the back panel 8 and the right front panel 10 of the insert assembly 1 is then stuffed through the left shoulder opening 80 into the cavity 74 as shown by the arrows in the drawing.

FIG. 4 shows the right strap 21 of the insert assembly 1 being pulled out of the right shoulder opening 81. The right sleeve 56 is then thrust through the right shoulder opening 14 of the insert assembly 1 as shown by the arrow in the drawing. The strap 21 then rests on the interior lining 52 where it joins the right sleeve 56 underneath the exterior shell. The right front panel 10 is then stuffed down into the right front cavity 76 as indicated by the arrow. When properly inserted, the assembly 1 fits between the exterior shell and the interior lining of the jacket/vest in the cavities 72, 74 and 76 and is held in place by gravity acting upon shoulder straps 17 and 21.

In. FIG. 5 the jacket/vest 50 is shown in partial section view with the right sleeve insert 2 positioned inside of the right sleeve 56. As seen from the drawing the right sleeve 56 is connected to and forms a part of the interior lining 52. The interior lining 52 is positioned inside of the exterior shell 57. As previously mentioned the interior lining 52 and the exterior shell 57 are joined together at the torso seam 66, the neck seam 64, the right front opening seam 70 and the left front opening seam 68. This configuration creates a left shoulder opening 80 between the left sleeve 54 and the exterior shell 102 and a right shoulder opening 81 between the right sleeve 56 and the exterior shell 57. An interior flap 104 is connected to and extends from the interior lining 52. The flap 104 extends circumferentially about the shoulder opening of the interior lining 52. Means for removably attaching the right sleeve insert 2 are positioned on the flap 104 to hold the sleeve insert 2 in position inside of the sleeve 56. The attaching means are fully detailed in the enlargement, FIG. 5A.

As previously disclosed in prior U.S. Pat. No. 4,569,098 a first zipper 150 is positioned in left sleeve 54. The zipper runs from the cuff to the shoulder opening of the sleeve. When the cuff is opened and the zipper is opened, the sleeve can be rolled back all the way to the shoulder opening 80. Right sleeve 56 likewise has a zipper therein 152 which runs from the cuff to the shoulder opening 81. When the cuff 154 is opened and the zipper 152 is opened, the sleeve 56 can be rolled back into the shoulder opening 81. When the sleeve is rolled back below the flap 104, a second strip of fastening material 156 located on the inside of the exterior shell 102 engages and mates with the first strip of fastening material 110, better seen in FIG. 5A. This ability to roll the sleeves and nestle them between the exterior lining 57 and the interior lining 52 is one of the novel features of the jacket/vest described in the aforementioned patent.

FIG. **5*a* is an enlargement of a portion of the means for removably attaching the sleeve insert 2 in the jacket/vest. The exterior lining 57*a* is shown in the uppermost part of the figure. The interior lining 52 becomes the right sleeve 56 as it exits the shoulder opening 81. Inside of the sleeve 56 is the right sleeve insert 2 which is removably attached to the interior flap 104. The interior flap 104 is connected to and extends from the interior lining 52. A first strip of fastening material 110 is connected to the flap 104. The fastening material 110 is positioned circumferentially about the shoulder opening of the flap 104. A third strip of fastening material 38 is attached to the right sleeve insert 2. The third strip of fastening material 38 is positioned along the interior covering 36 of the sleeve insert 2. The first strip of fastening material 110 mates with the second strip of fastening material 112 and thereby holds the sleeve insert 2** in place.

In FIG. 6 a partial section view of the jacket/vest 50 is shown. Inside of the right sleeve 56 is the right sleeve insert 2. Inside of the right front cavity 76 is the right front panel 10 of the insert assembly 1. As shown in the drawing the jacket/vest 50 becomes a fully insulated garment when the insert assembly 1 and the sleeve inserts 2 and 4 are fully positioned inside of the jacket/vest.

FIG. 7 is an alternative embodiment of the insert assembly. The inflatable personal flotation device shown in this view is commonly referred to as a Mae West type life preserver. The personal flotation device consists of a bladder 199 having a left front section 200, a right front section 202 and a neck section 204 (not shown in the drawing) which joins the left section 200 and the right section 202. The bladder forms an air tight cavity which can either be inflated by mouth through the stem 206 or by an automatic inflation means. The stem 206 has a releasable check valve 208 therein. The check valve 208 prevents the escape of gas from the interior of bladder 199 until the release mechanism is actuated. If for any reason, the subject is injured or is not able to inflate the vest by mouth an automatic inflation means generally described by the arrow 201 is provided. The automatic inflation means is well known to those skilled in the art and has been widely used on Mae West type personal flotation devices. The automatic inflation device includes a sealed compressed gas cylinder 212 which typically contains carbon dioxide. The cylinder threadably engages a manual operated piercing device 214. A ring pull 216 attaches by lanyard 218 to a piercing lever 220. The ring pull 216 is positioned on the outside of the exterior shell 57. When the pull 216 is actuated, the lever 220-drives a ram through the seal on the cylinder 220 and immediately retracts said ram from the sealed cylinder allowing the compressed gas to flow through the automatic inflation means 201 into the cavity of the bladder 199.

When inflated, the neck section 204, the left front section 200 and the right front section 202 surrounds the neck of the wearer and forces the person's face to be kept out of the water even if the person wearing the device is unconscious. This is especially beneficial in very cold water applications or in the event of injury.

In FIG. 8 a jacket 250 is shown. The jacket consists of an exterior shell 252, an interior lining 254, a left sleeve not shown and a right sleeve 256. The interior ling 254 is attached to the exterior shell at the torso seam 258, the collar seam 260, the left front opening seam, not shown, and the right front opening seam 262. Right sleeve 256 extends from a right shoulder opening 264 formed in the exterior shell 252. A right sleeve insert 266 is shown positioned inside of right sleeve 256 in partial section view. The right sleeve insert 266 has a hand opening at one end and a shoulder opening 268 at the other end. The right sleeve insert 266 has an exterior covering 272 and an interior covering 270. The interior covering 270 is sized to fit inside of and attach to the exterior covering 272. Positioned between the exterior covering 272 and the interior covering 270 of right sleeve insert 272 is a thermal insulator. The thermal insulator can be Thinsulate brand material, down, fiber, wool, or other suitable insulating material. Those skilled in the art will recognize that right sleeve insert 272 and the left sleeve insert can be manufactured in a unibody construction without the necessity of an exterior covering and an interior covering. For example, a thick layer of wool, cut from blanket like material, could be used to fabricate the left sleeve insert and right sleeve insert 272 without the need for exterior or interior coverings.

A strip of fastening material 274 is positioned circumferentially about the exterior covering 272 of the right sleeve insert 266. The first strip of fastening material 274 is designed to mate and engage with a second strip of fastening material 276 which is positioned on the interior of the sleeve 256. When the first strip of fastening material 274 engages the second strip of fastening material 276, the right sleeve insert 266 is releaseably attached to and held in place inside of the right sleeve 256.

There is a corresponding left sleeve and left sleeve insert for the jacket 250 which is a mirror image of the right sleeve and right sleeve insert described herein. The jacket 250 is capable of receiving an insert assembly 1 as previously described and shown in FIGS. 2 through 4. There are several differences between the jacket 250 and the jacket/vest 50. First, the jacket 250 does not contain the sleeve nestling features of the jacket/vest 50. Second, the jacket 250 has a different means of attaching the sleeve inserts therein.

In an alternative embodiment the sleeve inserts can be designed as a type of body armor in which ballistic cloth is placed between the exterior coverings and the interior coverings. Ballistic cloth such as Kelvar is suitable for this purpose or other types of ballistic material will do.

In another alternative embodiment a flotation means can be placed between the exterior coverings and the interior coverings of the sleeve inserts. Closed cell estomeric foam, kopoa or other non-hydrophobic substances may be used to manufacture a personal flotation device.

FIG. 9 shows an alternative embodiment of the removable insert assembly 300 for use with an alternatively designed jacket 302. The assembly 300 consists of a left front panel 304, a back panel 306, and a right front panel 3-8. Left front panel 304 is joined to back panel 306 at shoulder strap seam 310; there are no other seams joining left panel 304 to back panel 306. Right front panel 308 is joined to back panel 306 at shoulder strap seam 312; there are no other seams joining right panel 308 to back panel 306. Assembly 300 has left shoulder opening 314, neck opening 316 and right shoulder opening 318. Left front panel 304 and right front panel S18 are not joined to each other or to back panel 306 except at shoulder strap seams 310 and 312.

An exterior covering 350 fits over the exterior of left front panel 304, back panel 306 and right front panel 308. The left shoulder opening 314, right shoulder opening 318, neck opening 316, the left slit and the right slit are likewise formed in the exterior covering 350. An interior covering 352 is sized to fit inside of and attach to the exterior covering 350. The interior covering 352 is cut to correspond to the left shoulder opening 314, the right shoulder opening 318, the neck opening 316, the left slit and the right slit. A thermal insulator can be positioned between the exterior covering 350 and the interior covering 352. Thinsulate, down, wool or other types of thermal insulators are suitable for this purpose. Those skilled in the art will recognize that the insert assembly 300 can be manufactured in a unibody construction without the necessity of an exterior covering 350 and an interior covering 352. For example, a thick layer of wool, cut from blanket-like material, could be used to fabricate the insert assembly 300 without the need for exterior or interior coverings.

In an alternative embodiment the removable insert assembly can be designed as a type of body armor in which ballistic cloth is placed between the exterior covering 350 and the interior covering 352. Ballistic cloth such as Kelvar is suitable for this purpose or other types of ballistic material will do.

In another alternative embodiment a flotation means can be placed between the exterior covering 350 and the interior covering 352. Closed cell elastomeric foam, kopoa or other non-hydrophobic substances may be used to manufacture a personal flotation device.

FIG. 10 shows the assembly 300 in the jacket 302. An exterior shell 320 is joined to an interior lining 322 at left shoulder seam 324 and right shoulder seam 326. The exterior shell 320 is also joined to the interior lining at neck seam 328, left front opening seam 330 and right front opening seam 332, not shown. There is an opening 334 between the exterior shell and interior lining along the lower torso seam 336. The opening 334 along lower torso seam 336 is joined by a zipper 338 or other suitable fastening means. The zipper runs from the juncture of left front opening seam 330 around the bottom of the jacket along seam 336 to the juncture with the right torso seam. This type of jacket construction creates three cavities in the jacket between the shell and lining; a left front cavity, a rear cavity and a right front cavity.

To insert the assembly 300 in the jacket 302, the zipper 388 is opened exposing the opening 334 along the lower torso seam 336. The assembly 300 is stuffed into the rear cavity of the jacket 302 between the shell and lining. Then the right front panel 308 is brought over the right shoulder support area 340 of interior lining 322. The right front panel 308 fits into the right front cavity of the jacket 302. The left front panel 304 is then brought over the left shoulder support area, not shown, of interior lining 322, the left front panel 304 fits into the left front cavity of the jacket 302; the back panel 306 fits into the back panel of the jacket 302. The lower torso opening 334 is then closed and the assembly 300 is held in place by gravity being draped over right shoulder support area 340 and left shoulder support area, not shown. A right sleeve insert 346 fits into right sleeve 348 of jacket 302. The right sleeve insert is held in place by a first strip of fastening tape 350 which mates with a second strip of fastening tape 352. The first tape 350 or other suitable fastening means is circumferentially attached to the interior of sleeve 348 about the right shoulder opening as shown. The second tape 352 or other suitable fastening means is circumferentially attached to the exterior of right sleeve insert 346 at the shoulder opening.

While the foregoing is directed to the preferred embodiment of the present invention, other and further embodiments of the invention may be devised without departing from the basic scope thereof, and the scope thereof is determined by the claims which follow:

I claim:

1. A removable insert assembly which fits in a jacket, said jacket having an exterior shell, an interior lining, a left sleeve connected to said lining and a right sleeve connected to said lining, said insert assembly comprising: a removable vest sized to fit between said exterior shell and the interior lining of said jacket, said vest having;

a) an exterior covering having a back panel, a left front panel, a right front panel, a left shoulder opening and a right shoulder opening;

b) an interior covering sized to fit inside of and attach to said exterior covering, said interior covering having a left shoulder opening and a right shoulder opening; and c) a thermal insulator positioned between said exterior covering and said interior covering.

2. The apparatus of claim 1 further including:

a) a removable first tubular insert sized to fit inside the left sleeve of said jacket, said first tubular insert having;

i) a left exterior tubular covering having a hand opening at one end and a shoulder opening at the other end;

ii) a left interior tubular covering sized to fit inside of and attach to said left exterior tubular covering, said left interior tubular covering having a hand opening at one end and a shoulder opening at the other end; and iii) a thermal insulator positioned between said left exterior tubular covering and said left interior tubular covering;

b) a removable second tubular insert sized to fit inside the right sleeve of said jacket, said second tubular insert having;

i) a right exterior tubular covering having a hand opening at one end and a shoulder opening at the other end;

ii) a right interior tubular covering sized to fit inside of and attach to said right exterior tubular covering, said right interior tubular covering having a hand opening at one end and a shoulder opening at the other end; and iii) a thermal insulator positioned between said right exterior tubular covering and said right interior tubular covering;

c) means for removably attaching said first tubular insert in said left sleeve of said jacket and d) means for removably attaching said second tubular insert in said right sleeve of said jacket.

3. The apparatus of claim 2 wherein said means for removably attaching said first tubular insert in said left sleeve of said jacket comprises:

a) a first strip of fastening material attached to and arranged circumferentially about the shoulder opening of said left interior tubular covering; and b) a second strip of fastening material positioned to mate with said first strip of fastening material, said second strip of fastening material attached to an interior flap extending from the inside of said interior lining of said jacket, said flap arranged circumferentially about the shoulder opening of said lining.

4. The apparatus of claim 3 wherein said means for removably attaching said second tubular insert in said right sleeve of said jacket comprises:

a) a second strip of fastening material attached to and arranged circumferentially about the shoulder opening of said right interior tubular covering; and b) a fourth strip of fastening material positioned to mate with said second strip of fastening material, said fourth strip of fastening material att ached to an interior flap extending from the inside of said interior lining of said jacket said flap arranged circumferentially about the shoulder of opening of said lining.

5. The apparatus of claim 2 wherein said means for removably attaching said first tubular insert in said left sleeve of said jacket comprises:

a) a first strip of fastening material attached to and arranged circumferentially about the shoulder opening of said left exterior tubular covering; and b) a second strip of fastening material positioned to mate with said first strip of fastening material, said second strip of fastening material attached to and circumferentially arranged around the shoulder opening on the interior of said left sleeve of said jacket.

6. The apparatus of claim 5 wherein said means for removably attaching said second tubular insert in said right sleeve of said jacket comprises:

a) a third strip of fastening material attached to and arranged circumferentially about the shoulder opening of said right exterior tubular covering; an b) a fourth strip of fastening material positioned to mate with said second strip of fastening material, said fourth strip of fastening material attached to and circumferentially arranged around the shoulder on the interior of said left sleeve of said jacket.

7. A removable insert assembly which fits in a jacket, said jacket having an exterior shell. an interior lining, a left sleeve connected to said lining and a right sleeve connected to said lining, said insert assembly comprising: a removable vest sized to fit between said exterior shell and the interior lining of said jacket, said vest having;

a) an exterior covering having a back panel, a left front panel, a right front panel, a left shoulder opening and a right shoulder opening;

b) an interior covering sized to fit inside of and attach to said exterior covering, said interior covering having a left shoulder opening and a right shoulder opening;

c) ballistic cloth positioned between said exterior covering and said interior covering;

8. The apparatus of claim 7 further including:

a) a removable first tubular insert sized to fit inside the left sleeve of said jacket, said first tubular insert having;
   i) a left exterior tubular covering having a hand opening at one end and a shoulder opening at the other end;
   ii) a left interior tubular covering sized to fit inside of and attach to said left exterior tubular covering, said left interior tubular covering having a hand opening at one end and a shoulder opening at the other end; and
   iii) ballistic cloth positioned between said left exterior tubular covering and said left interior tubular covering;
b) a removable second tubular insert sized to fit inside the right sleeve of said jacket, said second tubular insert having;
   i) a right exterior tubular covering having a hand opening at one end and a shoulder opening at the other end;
   ii) a right interior tubular covering sized to fit inside said right exterior tubular covering, said right interior tubular covering having a hand opening at one end and a shoulder opening at the other end; and
   iii) ballistic cloth positioned between said right exterior tubular covering and said right interior tubular covering;
c) means for removably attaching said first tubular insert in said left sleeve of said jacket and
d) means for removably attaching said second tubular insert in said right sleeve of said jacket.

9. A removable insert assembly which fits in a jacket, said jacket having an exterior shell, an interior lining, a left sleeve connected to said lining, a right sleeve connected to said lining, said insert assembly comprising: a removable vest sized to fit between said exterior shell and the interior lining of said jacket, said vest having;
a) an exterior covering having a back panel, a left front panel, a right front panel, a left shoulder opening and a right shoulder opening:
b) an interior covering sized to fit inside of and attach to said exterior covering, said interior covering having a left shoulder opening and a right shoulder opening; and
c) flotation means positioned between said exterior covering and said interior covering.

10. The apparatus of claim 9 wherein said flotation means in closed cell elastomeric foam.

11. The apparatus of claim 9 further including:
a) a removable first tubular insert sized to fit inside the left sleeve of said jacket, said first tubular insert having;
   i) a left exterior tubular covering having a hand opening at one end and a shoulder opening at the other end;
   ii) a left interior tubular covering sized to fit inside of and attach to said left exterior tubular covering, said left interior tubular covering having a hand opening at one end and a shoulder opening at the other end; and
   iii) flotation means positioned between said left exterior tubular covering and said left interior tubular covering;
b) a removable second tubular insert sized to fit inside the right sleeve of said jacket, said second tubular insert having;
   i) a right exterior tubular covering having a hand opening at one end and a shoulder opening at the other end;
   ii) a right interior tubular covering sized to fit inside of and attach to said right exterior tubular covering, said right interior tubular covering having a hand opening at one end and a shoulder opening at the other end; and
   iii) flotation means positioned between said right exterior tubular covering and said right interior tubular covering;
c) means for removably attaching said first tubular insert in said left sleeve of said jacket and
d) means for removably attaching said second tubular insert in said right sleeve of said jacket.

12. The apparatus of claim 11 wherein said flotation means is closed cell elastomeric foam.

13. A removable insert assembly which fits in a jacket, said jacket having an exterior shell, an interior lining, a left sleeve connected to said lining and a right sleeve connected to said lining , said insert assembly comprising:
a) a removable vest sized to fit between said exterior shell and the interior lining of said jacket, said vest being primarily composed of a thermal insulator;
b) a removable first tubular insert sized to fit inside the left sleeve of said jacket, said first tubular insert being primarily composed of a thermal insulator;
c) a removable second tubular insert sized to fit inside the right sleeve of said jacket, said second tubular insert being primarily composed of a thermal insulator;
d) means for removably attaching said first tubular insert in said left sleeve of said jacket and
e) means for removably attaching said second tubular insert in said right sleeve of said jacket.

14. A removable insert assembly which fits in a jacket having an exterior shell, an interior lining, a left sleeve connected to said lining and a right sleeve connected to said lining, said insert assembly comprising:
a) a removable vest sized to fit between said exterior shell and the interior lining of said jacket, said vest being primarily composed of ballistic cloth;
b) a removable first tubular insert sized to fit inside the left sleeve of said jacket, said first tubular insert being primarily composed of ballistic cloth;
c) a removable second tubular insert sized to fit inside the right sleeve of said jacket, said second tubular insert being primarily composed of ballistic cloth;
d) means for removably attaching said first tubular insert in said left sleeve of said jacket and
e) means for removably attaching said second tubular insert in said right sleeve of said jacket.

15. A removable insert assembly which fits in a jacket, said jacket having an exterior shell, an interior lining, a left sleeve attached to said lining, a right sleeve attached to said lining, said insert assembly comprising:
a) a removable vest sized to fit between said exterior shell and the interior lining of said jacket, said vest being primarily composed of closed cell elastomeric foam;
b) a removable first tubular insert sized to fit inside the left sleeve of said jacket, said first tubular insert being primarily composed of closed cell elastomeric foam;
c) a removable second tubular insert sized to fit inside the right sleeve of said jacket, said second tubular insert being primarily composed of closed cell elastomeric foam;

d) means for removably attaching said first tubular insert in said left sleeve of said jacket and e) means for removably attaching said second tubular insert in said right sleeve of said jacket.

16. A removable insert assembly which fits in a jacket, said jacket having an exterior shell. an interior lining, a left sleeve connected to said lining and a right sleeve connected to said lining, said assembly comprising: a personal flotation device having;

a) a bladder having a left front section, a right front section and a neck section joining together said left and said right front sections of said bladder sized to fit between said exterior shell and the interior lining of said jacket; and b) means for inflating said bladder.

17. The apparatus of claim 16 wherein said means for inflating said bladder comprises:

a) a sealed cylinder containing compressed gas;

b) a means for releasing said compressed gas into said bladder.

18. The apparatus of claim 17 further including second means for inflating said bladder.

19. The apparatus of claim 18 wherein said second means for inflating said bladder comprises:

a) a blow pipe communicating with said bladder and positioned on said device so that it can be blown into by the mouth of the person wearing said jacket; and b) a check valve in said blow pipe to prevent the escape of gas from said bladder after inflation thereof.

20. A removable insert assembly which fits in a jacket through a lower torso seam, said jacket having an exterior shell, an interior lining, a left sleeve connected to said shell and said lining at a circumferential shoulder seam and a right sleeve connected to said shell and said lining at a circumferential shoulder seam, said insert assembly comprising: a removable vest sized to fit between said exterior shell and the interior lining of said jacket, said vest having;

a) an exterior covering having a back panel, a left front panel, a right front panel, a left shoulder opening and a right shoulder opening;

b) an interior covering sized to fit inside of and attach to said exterior covering, said interior covering having a left shoulder opening and a right shoulder opening; and c) a thermal insulator positioned between said exterior covering and said interior covering.

* * * * *